US005931707A

United States Patent [19]

Ito

[11] Patent Number: 5,931,707

[45] Date of Patent: Aug. 3, 1999

[54] CONNECTOR WITH TERMINAL HOOKING DEVICE

[75] Inventor: Nozomi Ito, Omiya, Japan

[73] Assignee: Kansei Corporation, Omiya, Japan

[21] Appl. No.: 08/831,084

[22] Filed: Apr. 1, 1997

[30] Foreign Application Priority Data

Apr. 1, 1996 [JP] Japan ..... 8-078924

[51] Int. Cl.[6] ..... H01R 13/514

[52] U.S. Cl. ..... 439/752; 439/595

[58] Field of Search ..... 439/752, 595

[56] References Cited

U.S. PATENT DOCUMENTS

| | | | |
|---|---|---|---|
| 5,108,319 | 4/1992 | Tsuji et al. | 439/752 |
| 5,205,763 | 4/1993 | Watanabe et al. | 439/752 |
| 5,397,249 | 3/1995 | Endo et al. | 439/595 |

FOREIGN PATENT DOCUMENTS

| | | |
|---|---|---|
| 0 505 199 | 8/1996 | European Pat. Off. . |
| 2-44463 | 11/1990 | Japan . |
| 7-114134 | 12/1995 | Japan . |

*Primary Examiner*—Steven L. Stephan
*Assistant Examiner*—Hae Moon Hyeon
*Attorney, Agent, or Firm*—Jacobson, Price, Holman & Stern, PLLC

[57] ABSTRACT

A connector comprises a connector housing (E) including a plurality of terminal housing compartments (1) in each of which terminal metal pieces (G) are disposed and a terminal hooking device (F) which is detachably attached to the connector housing (E) from the rear part of the connector housing (E) in two steps of a preliminary connection state and a complete connection state. The connector housing (E) has flexible hook pieces (3) which are formed in the terminal housing compartments (1) and are engaged with and hooked to the terminal metal pieces (G) when the terminal metal pieces (G) are inserted into the terminal housing compartments (1). The terminal hooking device (F) has a plurality of flexible holding pieces (2) which extend in a direction in which the terminal hooking device (F) is inserted into and detached from the terminal housing compartments (1). In the preliminary connection state, the flexible holding piece (2) climbs onto a pushing projection (6) formed in the terminal housing compartment (1) and thereby is positioned out of a line along which the terminal metal piece (G) is inserted and drawn. In this state, the terminal metal piece (G) is freely insertable and removable. When the complete connection state is reached, the flexible holding piece (2) is guided to a gliding slope (7) formed in the terminal housing compartment (1) and is projected at a position where the flexible holding piece (2) is connected to the terminal metal piece (G).

13 Claims, 7 Drawing Sheets

CONNECTOR WITH TERMINAL HOOKING DEVICE

BACKGROUND OF THE INVENTION

1. Field of the Invention

This invention relates to a connector with a terminal hooking device in which terminal metal pieces disposed inside of a connector housing are doubly fastened by both the terminal hooking device and the connector housing by attaching the terminal hooking device to the connector housing.

2. Description of the Prior Art

A connector with a terminal hooking device of this type is known as disclosed in Japanese Laid-Open Patent Publication No. Hei 5-190229.

As shown in FIGS. 12 and 13, the connector with a terminal hooking device is constructed such that a terminal hooking device B is inserted from the rear part of a connector housing A into the connector housing A having a plurality of terminal housing compartments 22 to which terminal metal pieces (not shown) are attached through two steps of a preliminary connection state and a complete connection state, so that the connector housing A, the terminal hooking device B, and the terminal metal pieces are tightly fastened together.

The terminal housing compartments 22 into which a housing space 21 defined with a hood 23 is partitioned by partition walls 22*b* and bottom walls 22*c* are formed in the connector housing A. Each of opened portions 22*a* is formed on a side where each of the terminal housing compartments 22 faces the hood 23. Each of engagement portions 24 used for a complete connection is formed in an appropriate position inside of the hood 23.

A main frame portion 29 which is engaged with the hood 23 is formed in the terminal hooking device B. The main frame portion 29 is made up of an upper plate portion 29*a*, a lower plate portion 29*b*, and a middle plate portion 29*c* used as a middle partition.

Engagement plates 35 are attached to the upper and lower surfaces of the main frame portion 29, and the engagement plates 35 are each designed to be turnable on a hinge 35*a*. When the terminal hooking device B is completely connected to the connector housing A, the engagement plates 35 are turned and laid in the hood 23. Accordingly, the outside surfaces thereof become even with the outside surfaces of the upper plate portion 29*a* and the lower plate portion 29*b*, so that the complete-connection engagement portions 24 are each engaged with a projection 36 used for a complete connection.

The terminal hooking device 8 has flexible holding pieces 30 corresponding to positions where the terminal metal pieces are laid. The connector housing A has flexible hook pieces 26 corresponding to positions where the terminal metal pieces are laid in the terminal housing compartments 22.

When the terminal hooking device B is in a preliminary connection state, each of the flexible holding piece 30 climbs on a pushing projection 28 formed on the side of the opened portion 22*a* of the side wall 22*b* of the terminal housing compartment 22. Thereby, the flexible holding piece 30 is positioned out of a line along which the terminal metal pieces are inserted into and removed from the terminal housing compartment 22.

When the preliminary connection state is shifted to a complete connection state, a driven projection 37 formed on the side end of the flexible holding piece 30 is engaged with a drive groove 38 formed in the connector housing A, and thereby the flexible holding piece 30 is guided forcefully to a position to be engaged with the terminal metal pieces.

However, in the conventional attachment of the terminal hooking device B to the connector housing A, the flexible holding piece 30 having a large lateral width Z which is inserted into each of the terminal housing compartments 22 is guided to the position to be connected to the terminal metal pieces by the engagement of the driven projection 37 with the drive groove 38.

Therefore, when the terminal metal pieces are inserted incompletely into the terminal housing compartment 22, the flexible holding piece 30 rides on the terminal metal piece and then is bent by twisting, by which the driven projection 37 might be disconnected from the drive groove 38. In the flexible holding piece 30 having the large lateral width Z which is inserted into, especially, each of the three or more terminal housing compartments 22, the driven projection 37 has a marked tendency to be disconnected from the drive groove 38.

A solution to the aforementioned disadvantage might be to reduce the lateral width Z of the flexible holding piece 30 so that the flexible holding piece 30 can be inserted into and removed from the terminal housing compartment 22.

According to this solution, however, a large number of flexible holding pieces 30 are required, and in addition, the driven projections 37 are required to be formed on both sides of each of the flexible holding pieces 30, and also the drive groove 38 corresponding to each of the driven projections 37 is required to be formed in the connector housing A.

As a result, disadvantageously, the lateral width Z' of the connector housing A becomes larger, and thus the whole connector is made large-sized.

SUMMARY OF THE INVENTION

It is an object of the present invention to provide a connector provided with a terminal hooking device in which the terminal hooking device is smoothly inserted into and removed from a connector housing, a large number of flexible holding pieces each having a shorter width are not required to be formed, and the whole connector is prevented from being made large-sized.

In order to achieve the object, a connector with a terminal hooking device according to the present invention comprises a connector housing having a plurality of terminal housing compartments in each of which a terminal metal piece is disposed, a terminal hooking device detachably attached to the connector housing from the rear part of the connector housing through two steps of a preliminary connection state and a complete connection state, flexible hook pieces which are formed in the terminal housing compartments and are engaged with the terminal metal pieces, and a plurality of flexible holding pieces formed in the terminal hooking device toward the terminal housing compartment each of which extends in a direction in which the terminal hooking device is inserted and removed. In the connector with the terminal hooking device, in the preliminary connection state, the flexible holding piece rides on a pushing projection formed in the terminal housing compartment and is positioned out of a line along which the terminal metal pieces are inserted and removed, and thereby the terminal metal pieces become insertable and removable. When the preliminary connection state is shifted to a complete connection state, the flexible holding piece is guided to a gliding slope formed in the terminal housing compartment and is projected at a position where the flexible holding piece is engaged with the terminal metal piece.

The connector with the terminal hooking device according to the present invention further comprises a first rail, formed on a side wall of the terminal housing compartment, which extends in a direction where the terminal metal pieces are inserted and removed and along which the flexible holding piece is guided, and a pushing projection formed in an appropriate position on the first rail.

The connector with the terminal hooking device according to the present invention further comprises a rib formed in the longitudinal direction of the flexible holding piece. The rib comes in contact with a second rail formed on a side wall of the terminal housing compartment, and thus the flexible holding piece is prevented from being excessively displaced when the flexible holding piece climbs on the pushing projection.

The second rail is provided with a gliding slope.

The tip of the flexible holding piece is provided with a projection on a side where the tip of the flexible holding piece is connected to the pushing projection so as to climb on the pushing projection.

The connector with the terminal hooking device according to the present invention further comprises a guiding slope, formed in the terminal housing compartment, for guiding the flexible holding piece.

DETAILED DESCRIPTION OF THE EMBODIMENT

An embodiment of a connector with a terminal hocking device according to the present invention will be hereinafter described with reference to the attached drawings.

FIGS. 1 to 11 show the embodiment of the present invention.

Figure 1:
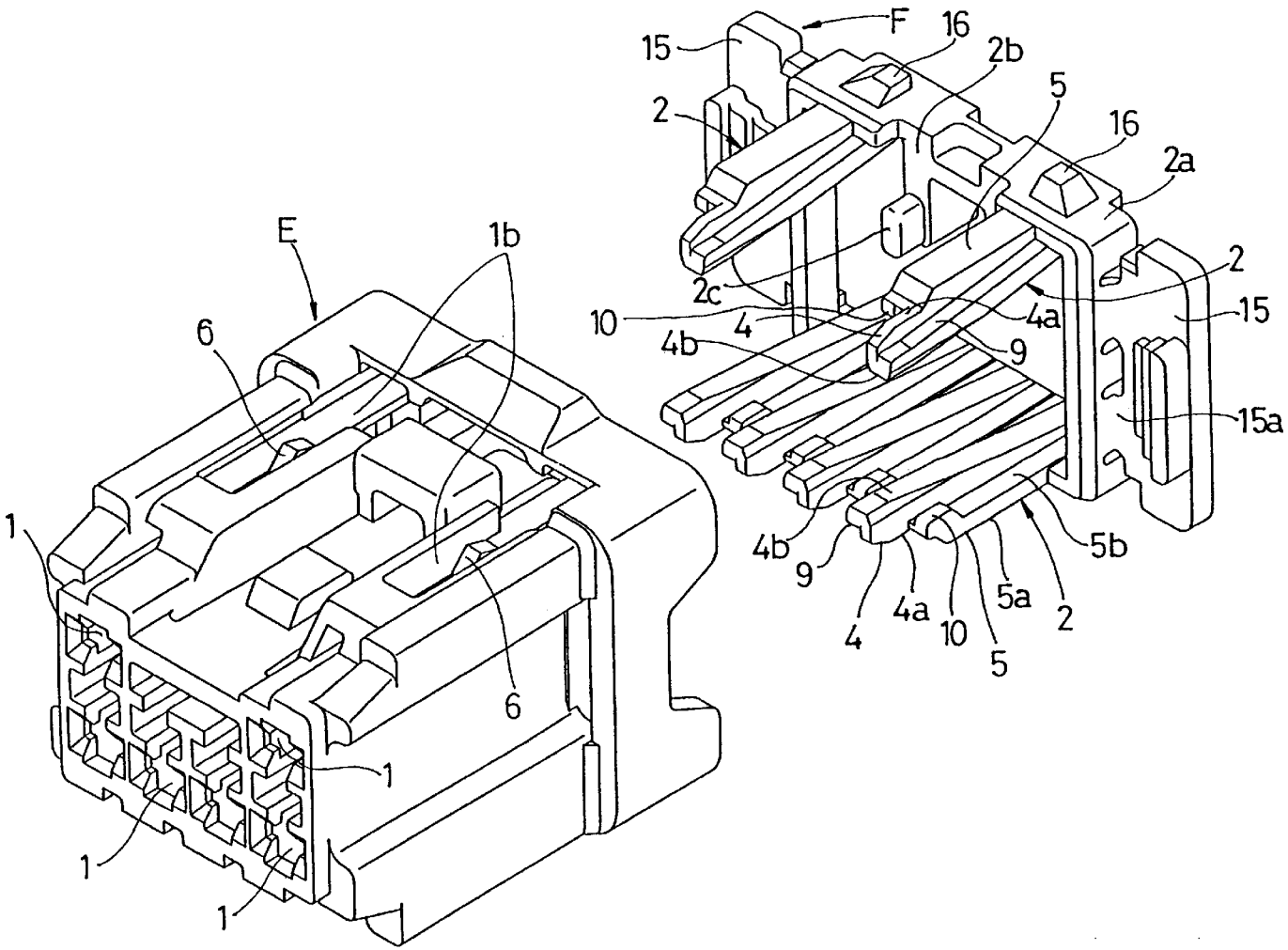
FIG. 1 is an exploded perspective view of a connector with a terminal hooking device according to an embodiment of the present invention.

In FIG. 1, reference character E designates a connector housing. A plurality of terminal housing compartments 1 are formed in the connector housing E, and a plurality of terminal metal pieces G are disposed in the terminal housing compartments 1.

The terminal hooking device F is inserted into the connector housing E from the rear part thereof through two steps of a preliminary connection state and a complete connection state.

The terminal hooking device F has a rectangular frame body portion 2*a*. A plurality of flexible holding pieces 2 are formed in the frame body portion 2*a*. The flexible holding piece 2 has substantially a long-square-pillar shape so as to be inserted into the terminal housing compartment 1.

The connector housing E has substantially a rectangular shape and includes the plurality of terminal housing compartments 1. The terminal housing compartment 1 is constructed such that the terminal metal pieces G can be inserted only from the rear part thereof. In this example, there are formed four terminal housing compartments 1 in the lower part and two terminal housing compartments 1 in the upper part. A flexible hook piece 3 which is engaged with the terminal metal pieces G is formed inside of the terminal housing compartment 1.

Figure 7:
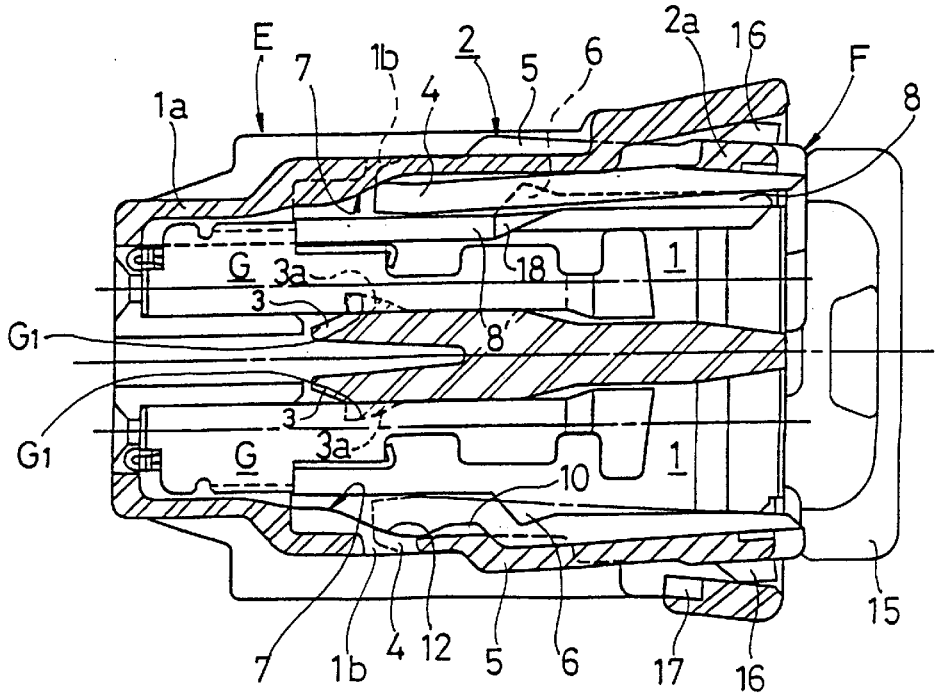
FIG. 7 is a sectional view of the connector with the terminal hooking device, showing a state immediately before the terminal hooking device reaches the complete connection state.

In the terminal housing compartment 1, the flexible hook piece 3 extends in the form of a cantilever from the rear part in the middle thereof. As shown in FIG. 7, a projection 3*a* which is engaged with an engagement slit $G_1$ of each of the terminal metal pieces G is formed on the side to which the terminal metal pieces G are attached. A first rail 8 along which the flexible holding piece 2 is guided in a direction where the terminal metal pieces G are inserted and removed is formed in a side wall (an upper side in FIG. 7) of the terminal housing compartment 1. A difference in level is formed in the middle of the first rail 8. A pushing projection 6 is formed on a side, which is opposite to a side of the level difference portion where the terminal metal pieces G are attached, and also on which the flexible holding piece 2 is guided. Thereby, the flexible holding piece 2 is pushed up so as to come off a line along which the terminal metal pieces G are inserted and removed.

In the terminal housing compartment 1, a guiding slope 18 is formed on which the flexible holding piece 2 is guided to be inserted. Thereby, the terminal hooking device F is always inserted in an appropriate position even though a posture where the flexible holding piece 2 is inserted varies widely.

Figure 6:
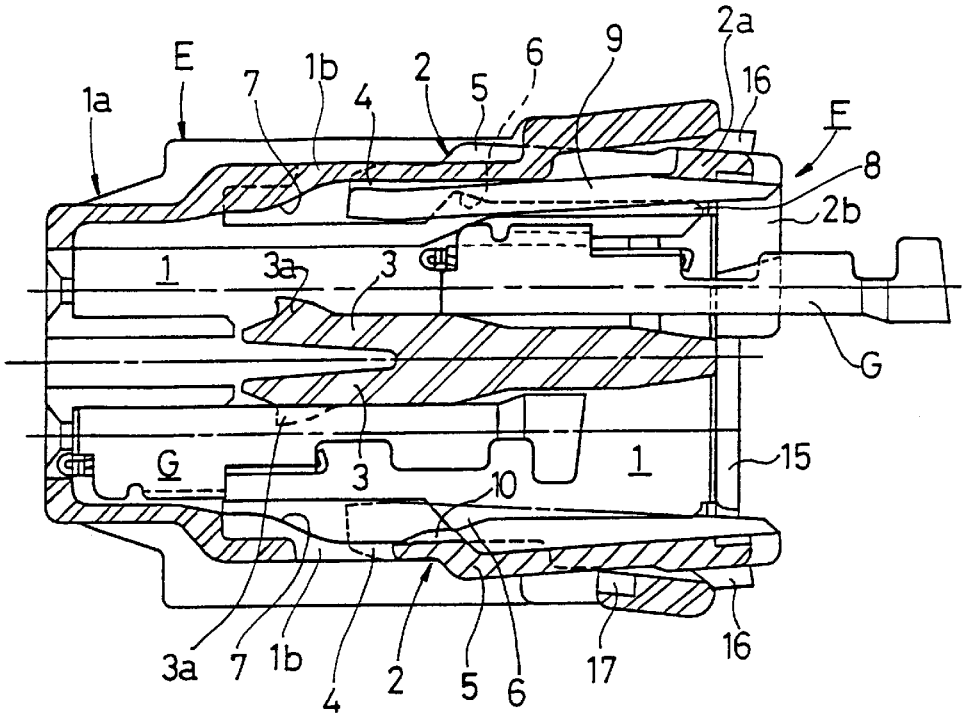
FIG. 6 is a sectional view showing that the terminal hooking device is in the preliminary connection state.

In the flexible holding piece 2, a long portion 4 and a short portion 5 whose end part is shorter than the long portion 4 are formed adjacently to and integrally with each other. As shown in FIG. 6, the short portion 5 climbs on the pushing projection 6 disposed in the connector housing E in a preliminary connection state of the terminal hooking device F, and thus the flexible holding piece 2 is shifted from the insertion-and-removal line of the terminal metal pieces G. Thereby, the flexible holding piece 2 can be taken in and out.

A projection 10 is formed inward at the end of the short portion 5. The projection 10 is constructed to climb onto the pushing projection 6 formed in the first rail 8.

As shown in FIG. 6, in a state where the short portion 5 has climbed on the pushing projection 6, as shown in the upper part of the sectional view of FIG. 6, the terminal metal pieces G are disposed inside of the terminal housing compartment 1. After that, as shown in the lower part of the sectional view of FIG. 6, the terminal metal pieces G are consecutively inserted into the terminal housing compartment 1, and thereby are engaged with the projection 3*a* formed in the flexible hook piece 3.

Figure 8:
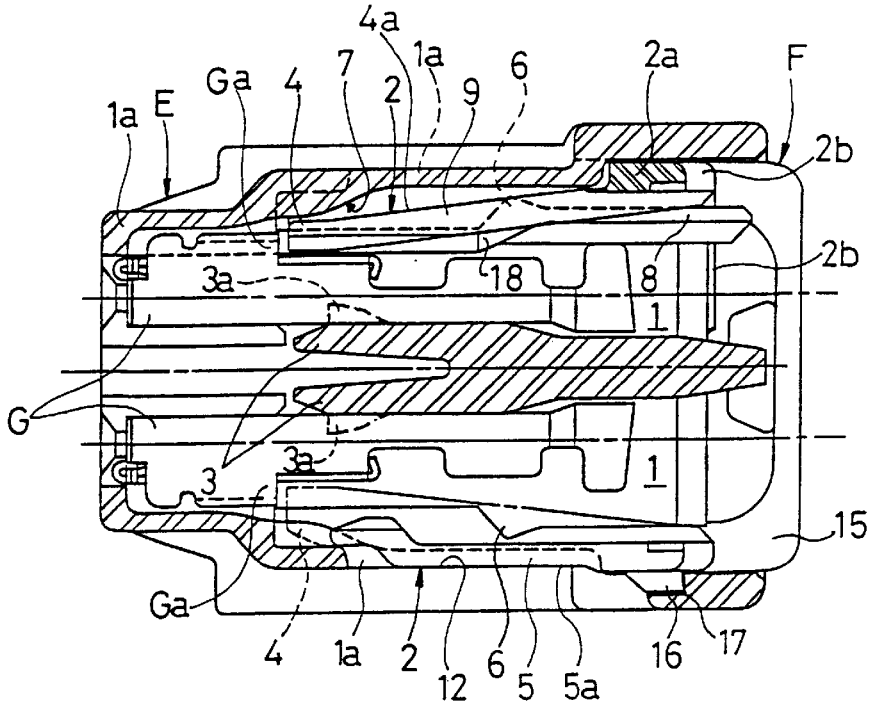
FIG. 8 is a sectional view showing that the terminal hooking device is in the complete connection state.

After the required terminal metal pieces G have been disposed inside of the plurality of terminal housing compartments 1 of the connector housing, as shown in FIG. 7, the terminal hooking device F is shifted from a preliminary connection state (FIG. 6) to a complete connection state (FIG. 7). When the complete connection state is reached, the long portion 4 is designed to be inserted along a gliding slope 7 of a second rail 12 formed in the terminal housing compartment 1. Thereby, as shown in FIG. 8, the tip of the flexible holding piece 2 is constructed to be inserted to a position of engagement with the terminal metal pieces G.

A rib 9 is formed in the long portion 4 in the longitudinal direction thereof. When the short portion 5 climbs on the pushing projection 6, the rib 9 comes in contact with the second rail 12 formed in the side wall opposite to the side of the pushing projection 6, so that excessive displacement of the flexible holding piece 2 does not occur.

Figure 4:
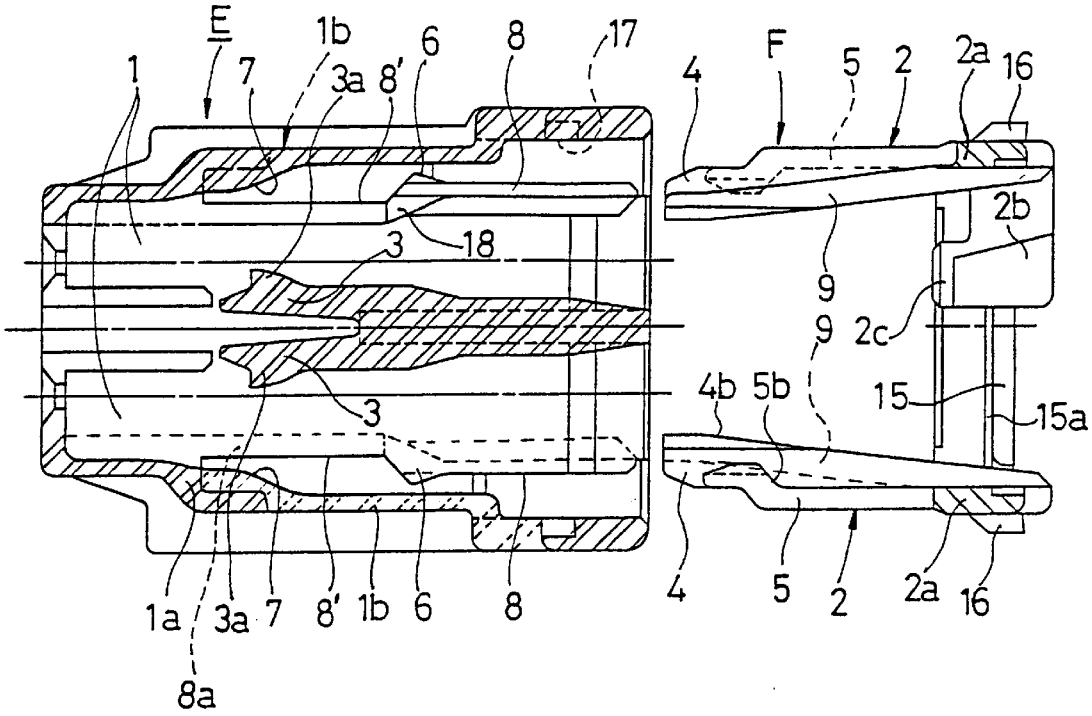
FIG. 4 is an exploded sectional view of the connector with the terminal hooking device.
Figure 5:
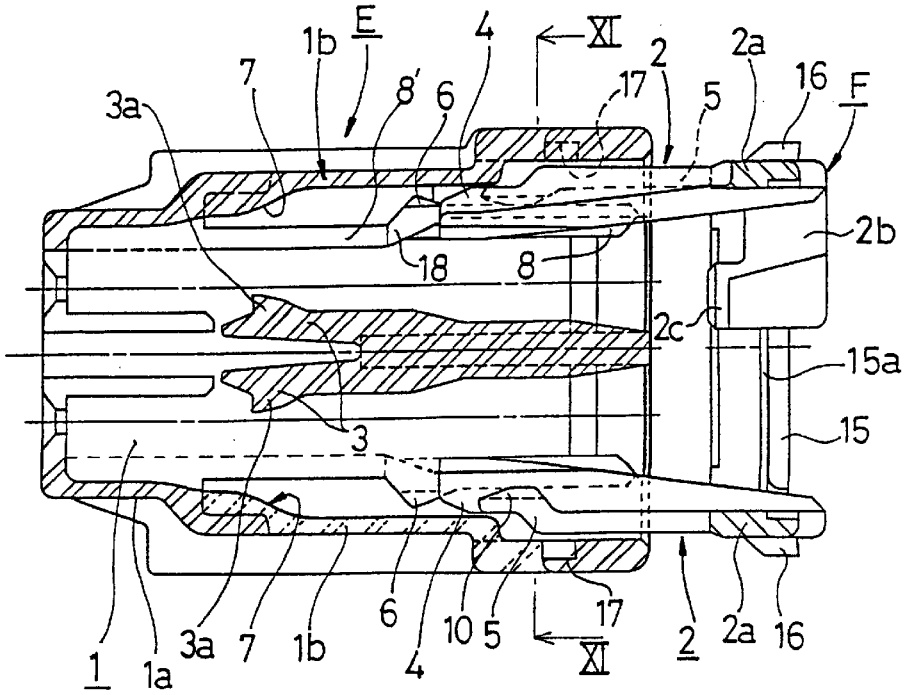
FIG. 5 is a sectional view of the connector with the terminal hooking device, showing a state immediately before the terminal hooking device reaches the preliminary connection state.

An outer surface 4*a* of the long portion 4 is made even with an outer surface 5*a* of the short portion 5. However, as shown in FIGS. 1 and 4, an inner surface 4*b* of the long portion 4 is formed to be positioned more inwardly than an inner surface 5*b* of the short portion 5.

Reference character 15 designates an engagement plate which is attached to the terminal hooking device F by being connected to a hinge portion 15*a*. In the preliminary connection state, the engagement plate 15 comes in contact with the rear end edge of the connector housing E, and thereby the terminal hooking device F is prevented from being shifted to the complete connection state.

When the preliminary connection state is shifted to the complete connection state, the hinge portion 15*a* is bent, and the engagement plate 15 is inserted into the inside of the connector housing E. Thereafter, a projection 16 used for the complete connection, which is formed in the terminal hooking device F, is engaged with a concave portion 17 used for the complete connection, which is formed in the connector housing E. Thereby, the complete connection state can be retained.

There will now be described a mounting operation of the connector with the terminal hooking device according to the embodiment.

Figure 2:
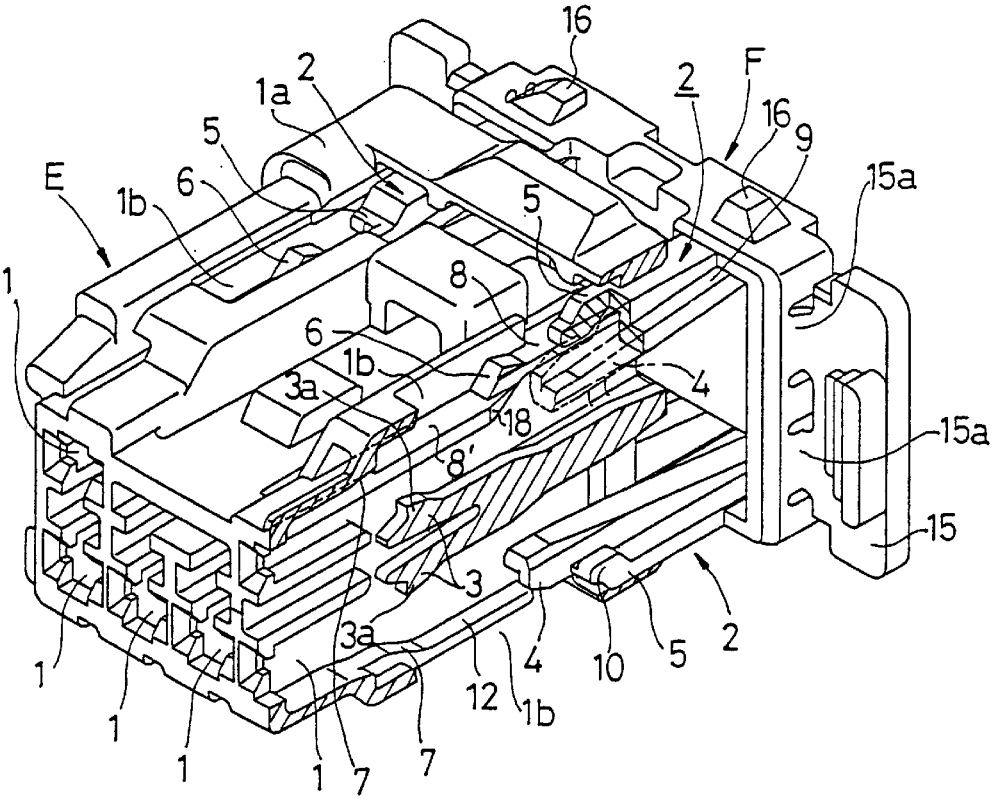
FIG. 2 is a partially broken perspective view of the connector with the terminal hooking device, showing a state immediately before the terminal hooking device reaches a preliminary connection state.

As shown in FIG. 4, the flexible holding piece 2 disposed in the terminal hooking device F is inserted into the terminal housing compartment 1 of the connector housing E. At this time, as shown in FIGS. 2 and 4, the projection 10 of the short portion 5 of the flexible holding piece 2 is inserted to a position where the projection 10 climbs on the first rail 8 formed in the terminal housing compartment 1. Thereby, the flexible holding piece 2 of the terminal hooking device F moves forward in the rear part of the connector housing E while gliding the first rail 8.

As shown in FIG. 2, the pushing projection 6 is formed substantially in the middle of the first rail 8, and an end portion 8' closer to the tip than the pushing projection 6 has such a shape as to sink from the front part of the pushing projection 6 onto the side of the terminal housing compartment 1. Since a guiding slope 18 is formed below the pushing projection 6, the tip of the long portion 4 of the flexible holding piece 2 cores in contact with the guiding slope 18 and thus is directed in a direction in which it is inserted into the terminal housing compartment 1. Thereby, the terminal hooking device F is inserted smoothly into the terminal housing compartment 1.

Figure 3:
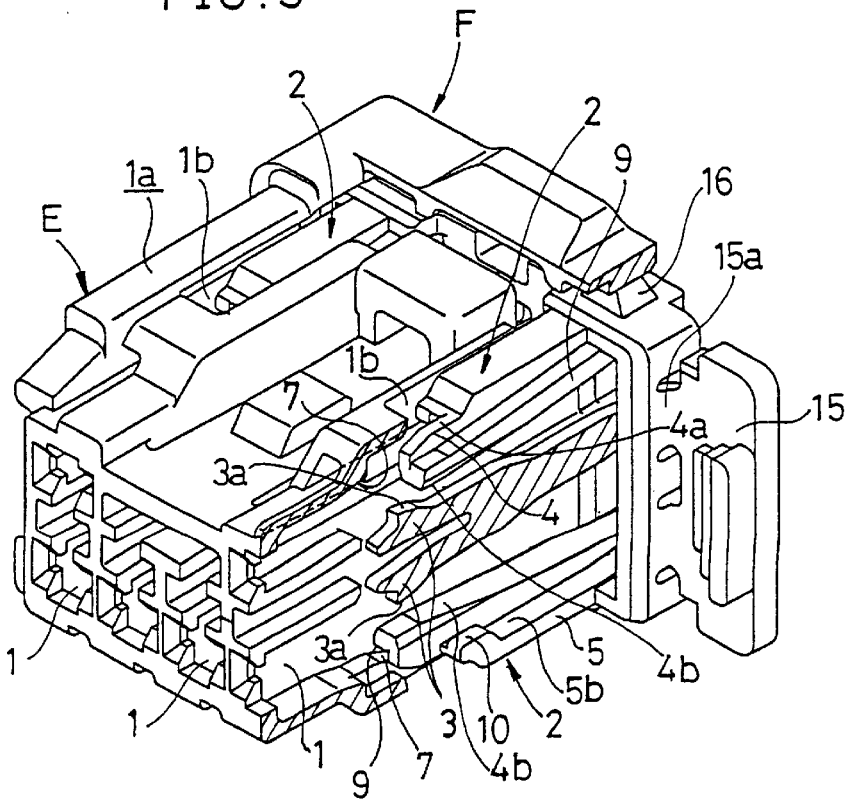
FIG. 3 is a partially broken perspective view showing that the terminal hooking device is in the preliminary connection state.

When the terminal hooking device F is inserted consecutively, as shown in FIG. 6, the projection 10 of the short portion 5 is caused to climb on the pushing projection 6 of the first rail 8. As shown in FIGS. 3 and 6, a part of the flexible holding piece 2 enters an opening portion 1*b* formed in a connector housing body 1*a*, and thus comes off the insertion-and-removal line of the terminal metal pieces G into and from the terminal housing compartment 1.

Figure 11:
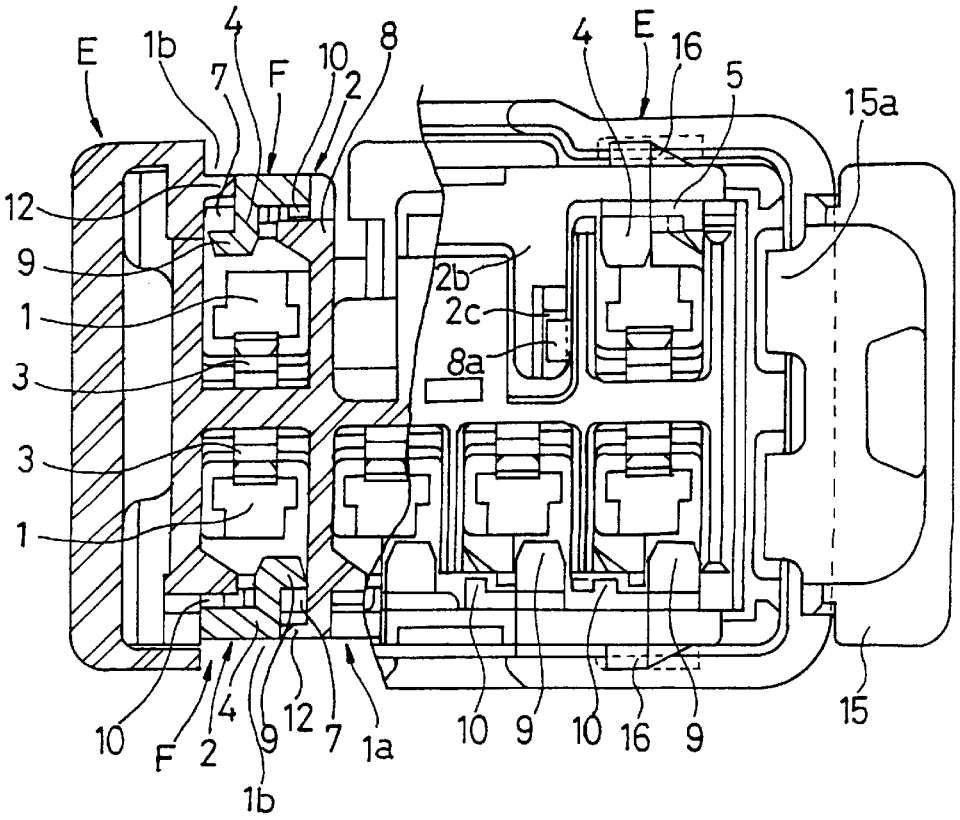
FIG. 11 is a sectional view (partly including a plan view) of the connector with the terminal hooking device taken along line XI—XI of FIG. 5.
Figure 12:
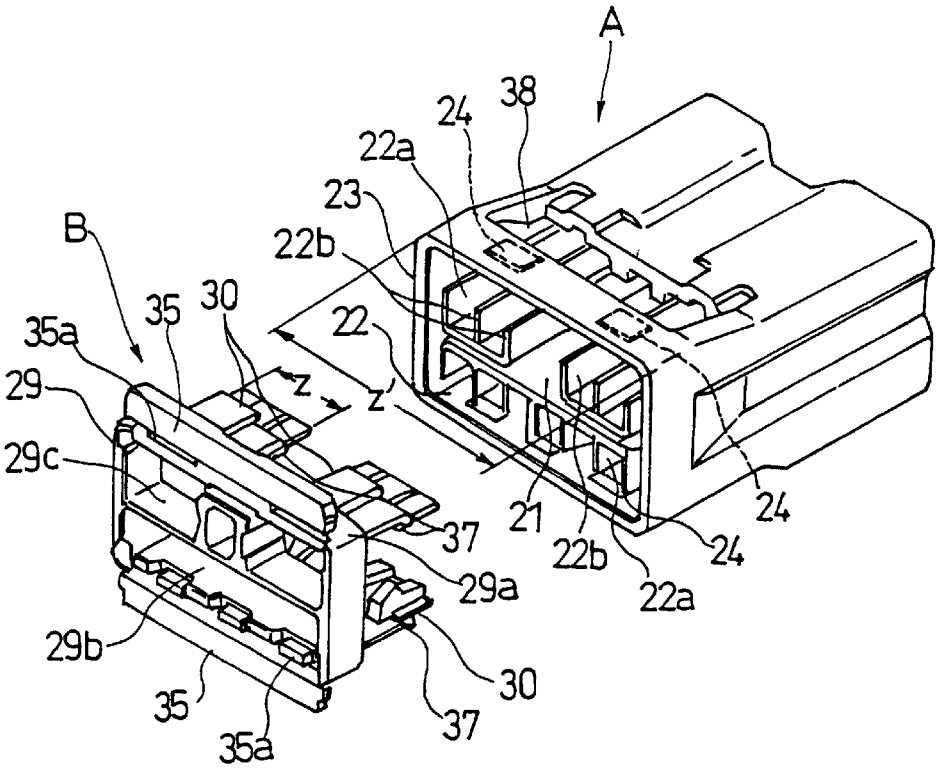
FIG.12 PRIOR ART
FIG. 12 is an exploded perspective view of a conventional connector with a terminal hooking device.
Figure 13:
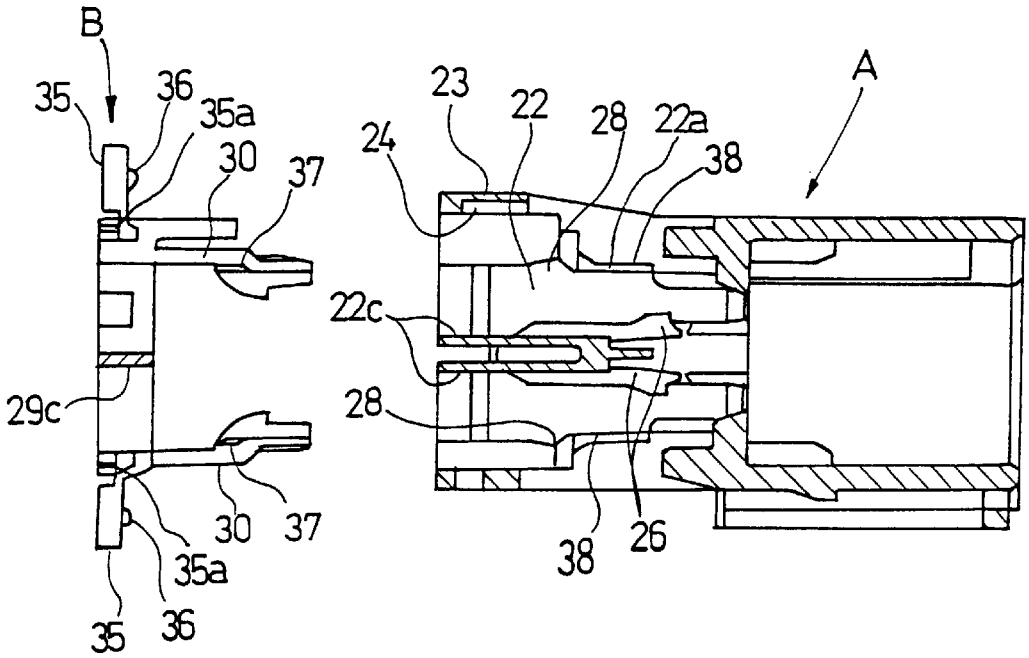
FIG.13 PRIOR ART
FIG. 13 is an exploded sectional view of the conventional connector with a terminal hooking device.

In this embodiment, as shown in FIG. 11, even though the flexible holding piece 2 comes off the insertion-and-removal line, the rib 9 formed in the side plane of the long portion 4 comes in contact with the second rail 12 formed in the connector housing body 1*a*, and accordingly the flexible holding piece 2 does not cause excessive displacement.

The terminal hooking device F is inserted into the connector housing E where the terminal metal piece G has been inserted in the terminal housing compartment 1. In this way, the preliminary connection state is realized. The preliminary connection state is kept in a connector provided with a terminal hooking device having the following construction.

As soon as the projection 10 of the short portion 5 climbs on the pushing projection 6 of the first rail 8, as shown in FIGS. 6 and 11, the engagement plate 15 of the terminal hooking device F comes in contact with the rear end edge of the connector housing E, so that the terminal hooking device F cannot be inserted into the connector housing E.

Figure 9:
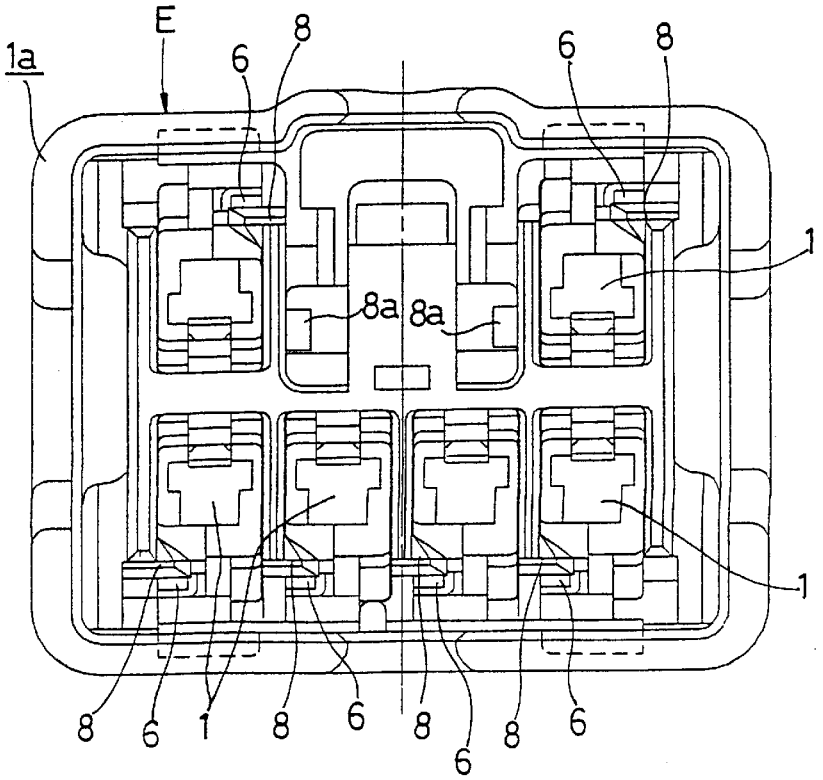
FIG. 9 is a plan view of a connector housing E according to the embodiment.
Figure 10:
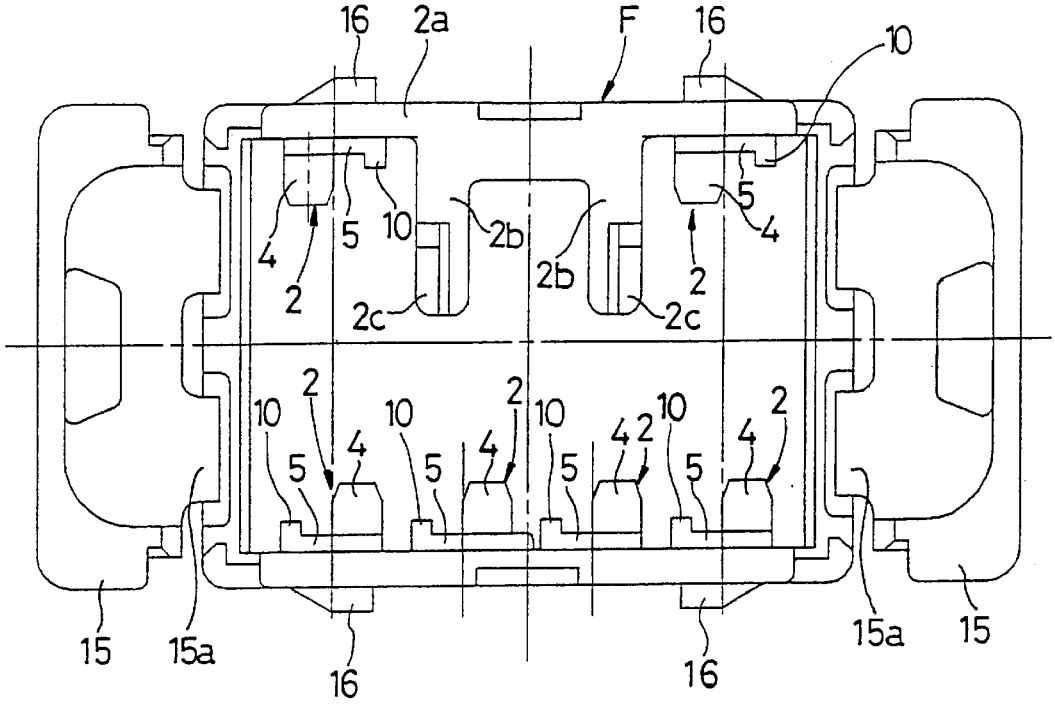
FIG. 10 is a plan view of the terminal hooking device.

In addition, as soon as the projection 10 climbs on the pushing projection 6, as shown in FIGS. 1 and 10, engagement projections 2*c*, 2*c* of the lower ends of a pair of cantilevers 2*b*, 2*b* disposed in the frame body portion 2*a* of the terminal hooking device F comes in contact with a pair of middle projections 8*a*, 8*a* disposed in the middle of the connector housing E as shown in FIG. 9. Thereby, as shown in FIG. 11, the cantilevers 2*b*, 2*b* are displaced in a direction adjacent to each other, and the engagement projections 2*c*, 2*c* are moved over the middle projections 8*a*, 8*a*, and thus the displacement returns to the initial position.

Accordingly, the terminal hooking device F is prevented from being disconnected from the connector housing E, and the preliminary connection state is kept.

In the aforementioned condition that the preliminary connection state is kept, as shown in the upper part of the sectional view of FIG. 6, the terminal metal pieces G are inserted into the terminal housing compartment 1, and, as shown in the lower part of the sectional view of FIG. 6, the terminal metal pieces G which are required are inserted into the terminal housing compartment 1. Thereby, the terminal metal pieces G are hooked to the flexible hook piece 3, and are prevented from being disconnected from the terminal housing compartment 1.

As shown in FIG. 7, all of the required terminal metal pieces G are inserted into the terminal housing compartment 1, and are hooked to the flexible hook piece 3. Thereafter, each of the engagement plates 15, 15 of the terminal hooking device F is erected in a direction perpendicular to the frame body portion 2*a*. Thereby, the engagement of the engagement plates 15, 15 with the rear end edge of the connector housing E is released. Thereafter, the terminal hooking device F is reinserted into the connector housing E.

As shown in FIG. 7, the insertion of the terminal hooking device F causes the projection 10 of the short portion 5 to climb over the pushing projection 6 and then ride on the end portion 8' of the first rail 8.

Accordingly, as shown in FIGS. 3 and 6, each of the flexible holding pieces 2 moves away from the opening portion 1*b* formed in the connector housing body 1*a*, and then returns onto the insertion-and-removal line of the terminal metal pieces G disposed in the terminal housing compartment 1.

When the terminal hooking device F is inserted deeper, as shown in FIG. 7, the tip of the long portion 4 of the flexible holding piece 2 comes in contact with the gliding slope 7 which is formed in the connector housing body 1*a*, and then descends toward the inside of the terminal housing compartment 1 while gliding on the gliding slope 7. When the terminal hooking device F has inserted into the terminal housing compartment 1, as shown in FIG. 8, the tip of the long portion 4 projects behind a step portion Ga of the terminal metal pieces G. Therefore, the terminal hooking device F reaches a state of being completely connected to the connector housing E. This complete connection state is kept as follows.

As shown in FIG. 8, as soon as the terminal hooking device F reaches the complete connection state, the projection 16 formed in the frame body portion 2*a* is engaged with the concave portion 17. Therefore, the terminal hooking device F is kept in a state of not being disconnected from the connector housing E.

Accordingly, the terminal metal pieces G are prevented from being disconnected from the terminal housing compartment 1, doubly by being hooked to the flexible hook piece 3 and being engaged with the flexible holding piece 2.

The embodiment of the present invention was described as above. An effect of the present invention will now be described.

Since the plurality of flexible holding pieces 2, each of which corresponds to each of the terminal housing compartments 1 of the connector housing E including the plurality of terminal housing compartments 1, are disposed in the terminal hooking device F, the flexible holding piece 2 is taken in and out of each of the terminal housing compartments 1. Therefore, an inserting operation of the terminal hooking device F into the connector housing E is performed without failure. Additionally, when the terminal metal pieces G are incompletely inserted into the terminal housing compartment 1, the long portion 4 of the flexible holding piece 2 comes in contact with the top surface of the terminal metal pieces G, and thus the terminal hooking device F is prevented from being inserted into the terminal housing compartment 1. As a result, the terminal hooking device F which has been incompletely inserted can be reliably detected. This makes it possible to prevent the incomplete insertion.

Further, since the long portion 4 and the short portion 5 are formed adjacently to and integrally with each other, the function of disconnecting the flexible holding piece 2 from the insertion-and-removal line of the terminal metal pieces G can be performed when the short portion 5 remains riding on the pushing projection 6 in the preliminary connection state.

Further, the first rail 8 extending in a direction where the terminal metal pieces G are inserted is formed in the side wall of the terminal housing compartment 1, and the short portion 5 is guided along the first rail 8. Since the pushing projection 6 is formed in an appropriate position on the first rail 8, the flexible holding piece 2 is disposed inside of the terminal housing compartment 1. Especially, the flexible holding piece 2 has a lateral width short enough to be disposed inside of the terminal housing compartment 1. As a consequence, the size of the connector housing E becomes smaller because the lateral width thereof does not become larger, and additionally, a function of hooking doubly the terminal metal pieces G can be performed.

Further, when the terminal hooking device F is inserted into the connector housing E, the short portion 5 enters the terminal housing compartment 1 by being guided along the first rail 8. Consequently, the flexible holding piece 2 is easily inserted into the terminal housing compartment 1, and the terminal hooking device F is easily inserted into the connector housing E.

Further, since the rib 9 extends in the longitudinal direction of the long portion 4, when the short portion 5 rides on the pushing projection 6, the rib 9 comes in contact with the second rail 12, so that excessive displacement of the flexible holding piece 2 does not occur. Therefore, when the preliminary connection state is shifted to the complete connection state, the long portion 4 of the flexible holding piece 2 glides along the gliding slope 7 of the second rail 12. Thereby, an inserting operation of the flexible holding piece 2 into a position of being engaged with the terminal metal pieces G can be performed smoothly and steadily.

Further, since the inner surface 4*b* of the long portion 4 is formed to be positioned more inwardly than the inner surface 5*b* of the short portion 5, the pushing projection 6 of the connector housing E which comes in contact with the short portion 5 becomes possible to be formed at a position of a step made by the short portion 5 and the long portion 4 such that it projects toward the inside of the terminal housing compartment 1. As a result, the size of the whole connector housing E can be made smaller because the lateral width of the terminal housing compartment 1 can be made smaller.

Further, the projection 10 is formed inward at the end of the short portion 5, and the projection 10 is constructed to ride on the pushing projection 6. Accordingly, when the terminal hooking device F is inserted from the rear part of the connector housing E thereinto, the projection 10 comes in contact with a smaller-area part of the first rail 8. Consequently, the friction generated at an insertion time can be lowered so that the insertion can be made with smaller insertion force.

Further, since the guiding slope 18 for guiding the insertion of the flexible holding piece 2 is disposed in the terminal housing compartment 1, the flexible holding piece 2 can always be inserted smoothly and can be engaged with the terminal metal pieces G even though a posture where the flexible holding piece 2 is inserted varies widely.

In the aforementioned embodiment, the long portion 4 is formed integrally with the short portion 5. However, they can also be constructed such that the long portion 4 is disposed in a direction where the short portion 5 moves, and also is bent together with the short portion 5. In other words, the long portion 4 can also be constructed to be separated from the short portion 5.

The pushing projection 6 is not necessarily formed in the first rail 8. The pushing projection 8 may be disposed inside of the terminal housing compartment 1.

What is claimed is:

1. A connector with a terminal hooking device, comprising:

a connector housing including a plurality of terminal housing compartments in each of which each of a plurality of terminal metal pieces is disposed;

said terminal hooking device detachably attached to said connector housing from a rear part of said connector housing through two steps of a preliminary connection state and a complete connection state;

a plurality of flexible hook pieces, each formed in each of said terminal housing compartments, each of which is engaged with each of said terminal metal pieces;

a plurality of flexible holding pieces, formed in said terminal hooking device, which extend in a direction in which said terminal hooking device is inserted into and drawn from said connector housing;

a plurality of first rails, each formed on a side wall of each of said terminal housing compartments, which extend in the direction in which said terminal metal pieces are inserted and removed and along which said flexible holding pieces are guided;

a plurality of pushing projections, each formed at an appropriate position on each of said first rails; and a plurality of ribs, each formed on each of said flexible holding pieces in a longitudinal direction of said flexible holding pieces, each of said ribs coming in contact with each of a plurality of second rails, each formed on a side wall of each of said terminal housing compartments so as not to cause excessive displacement of said flexible holding pieces when said flexible holding pieces climb on said pushing projections;

wherein in the preliminary connection state, said flexible holding pieces climb onto said pushing projections, respectively, and thereby are positioned out of a line along which each of said terminal metal pieces is inserted and removed, so that said terminal metal pieces become insertable and removable and, when the preliminary connection state is shifted to the complete connection state, said flexible holding pieces are guided to a plurality of first slopes, each formed in each of said terminal housing compartments, and are projected at a position where said flexible holding pieces are engaged with said terminal metal pieces.

2. The connector with a terminal hooking device according to claim 1, wherein each of said first slopes are formed on each of said plurality of second rails.

3. The connector with a terminal hooking device according to claim 1, wherein a tip of each of said flexible holding pieces at a side where said flexible holding pieces are fitted to said pushing projections is formed to be projected so that said flexible holding pieces can climb on said pushing projections respectively.

4. The connector with a terminal hooking device according to claim 1, wherein each of said terminal housing compartments is provided with a second slope for guiding each of said flexible holding pieces in said preliminary connection state.

5. The connector with a terminal hooking device according to claim 4, wherein each of said second slopes are formed on each of said plurality of first rails.

6. A connector with a terminal hooking device, comprising:

a connector housing including a plurality of terminal housing compartments in each of which each of a plurality of terminal metal pieces is disposed;

said terminal hooking device detachably attached to said connector housing from a rear part of said connector housing through two steps of a preliminary connection state and a complete connection state;

a plurality of flexible hook pieces, each formed in each of said terminal housing compartments, each of which is engaged with each of said terminal metal pieces; and a plurality of flexible holding pieces, formed in said terminal hooking device, each of which comprises a long portion and a short portion extending in a direction in which said terminal hooking device is inserted into and drawn from said connector housing;

wherein in the preliminary connection state, said short portions of said flexible holding pieces climb onto a plurality of pushing projections formed in said terminal housing compartment, respectively, and thereby said flexible holding pieces are positioned out of a line along which each of said terminal metal pieces is inserted and removed, so that said terminal metal pieces become insertable and removable and, when the preliminary connection state is shifted to the complete connection state, said long portions of said flexible holding pieces are guided to a plurality of first slopes, each formed in each of said terminal housing compartments, and are projected at a position where said flexible holding pieces are engaged with said terminal metal pieces.

7. The connector with a terminal hooking device according to claim 6, wherein each of said short portions and said long portions are formed adjacently to and integrally with each other.

8. The connector with a terminal hooking device according to claim 6, wherein each of said terminal housing compartments is provided with a second slope for guiding each of said long portions of said flexible holding pieces in said preliminary connection state.

9. The connector with a terminal hooking device according to claim 6, further comprising a plurality of first rails, each formed on a side wall of each of said terminal housing compartments, which extend in the direction in which said terminal metal pieces are inserted and removed and along which said short portions of said flexible holding pieces are guided.

10. The connector with a terminal hooking device according to claim 9, further comprising a plurality of pushing projections, each formed at an appropriate position on each of said first rails.

11. The connector with a terminal hooking device according to claim 10, wherein a tip of each of said short portions of said flexible holding pieces at a side where said short portions are fitted to said pushing projections is formed to be projected so that said short portions can climb on said pushing projections respectively.

12. The connector with a terminal hooking device according to claim 6, further comprising a plurality of ribs, each formed on each of said long portions of said flexible holding pieces in a longitudinal direction of said flexible holding pieces, each of said ribs coming in contact with each of a plurality of second rails, each formed on a side wall of each of said terminal housing compartments so as not to cause excessive displacement of said flexible holding pieces when said short portions of said flexible holding pieces climb on said pushing projections.

13. The connector with a terminal hooking device according to claim 12, wherein each of said first slopes are formed on each of said plurality of second rails.

* * * * *